US007810261B2

(12) United States Patent
Rosendale et al.

(10) Patent No.: US 7,810,261 B2
(45) Date of Patent: Oct. 12, 2010

(54) ANIMATED FOLDABLE CARD

(75) Inventors: David John Rosendale, Torrance, CA (US); Timothy P. Clegg, Manhattan Beach, CA (US)

(73) Assignee: Americhip, Inc., Torrance, CA (US)

( * ) Notice: Subject to any disclaimer, the term of this patent is extended or adjusted under 35 U.S.C. 154(b) by 278 days.

(21) Appl. No.: 12/179,413

(22) Filed: Jul. 24, 2008

(65) Prior Publication Data

US 2010/0018091 A1 Jan. 28, 2010

(51) Int. Cl.
*G09F 19/00* (2006.01)

(52) U.S. Cl. ..... 40/445; 40/124.09; 446/149; 446/150

(58) Field of Classification Search ..... 40/445, 40/124.09; 446/147, 149, 150, 151
See application file for complete search history.

(56) References Cited

U.S. PATENT DOCUMENTS

| | | | | | |
|---|---|---|---|---|---|
| 190,588 | A | | 5/1877 | Holding | |
| 418,135 | A | * | 12/1889 | Kaufmann | 40/491 |
| 946,407 | A | * | 1/1910 | Spiegel | 40/445 |
| 1,141,172 | A | | 6/1915 | Clark | |
| 1,211,497 | A | * | 1/1917 | Spiegel | 40/445 |
| 1,259,297 | A | * | 3/1918 | Russell | 40/445 |
| 2,107,450 | A | | 2/1938 | Miller | |
| 2,298,601 | A | | 5/1940 | Tremblett | |
| 2,367,967 | A | | 11/1942 | Schwartz | |
| 4,286,399 | A | | 9/1981 | Funahashi et al. | |
| 4,433,783 | A | | 2/1984 | Dickinson | |
| 4,607,747 | A | | 8/1986 | Steiner | |
| 4,611,262 | A | | 9/1986 | Galloway et al. | |
| 4,614,266 | A | | 9/1986 | Moorhead | |
| 4,703,573 | A | | 11/1987 | Montgomery et al. | |
| 4,791,741 | A | | 12/1988 | Kondo | |
| 4,847,124 | A | | 7/1989 | Lux nee Andrieux | |
| 4,866,865 | A | | 9/1989 | Yang | |
| 5,063,698 | A | | 11/1991 | Johnson et al. | |
| 5,230,501 | A | | 7/1993 | Melton | |
| 5,245,171 | A | | 9/1993 | Fox et al. | |
| 5,275,285 | A | | 1/1994 | Clegg | |
| 5,577,918 | A | | 11/1996 | Crowell | |
| 5,761,836 | A | | 6/1998 | Dawson | |
| 5,778,574 | A | | 7/1998 | Reuben | |
| 5,845,218 | A | | 12/1998 | Altschul | |
| 5,901,484 | A | | 5/1999 | Seder | |
| 6,104,306 | A | | 8/2000 | Hogue et al. | |

(Continued)

*Primary Examiner*—Gary C Hoge
(74) *Attorney, Agent, or Firm*—Jeffer Mangels; Butler & Mitchell LLC

(57) ABSTRACT

An animated foldable card that includes a base page, shield page, first intermediate page and second intermediate page all having top, bottom, left and right edges. The shield page includes a window defined therein and its bottom edge is hingedly connected to the top edge of the base page. The right edge of the first intermediate page is hingedly connected to the left edge of the base page, and the right edge of the second intermediate page is hingedly connected to the left edge of the first intermediate page. The card also includes a moveable page having top, bottom, left and right edges. The right edge of the moveable page is hingedly connected to the left edge of the second intermediate page, and the moveable page includes one of either a plurality of shutter elements or at least one coded image associated therewith. Either the base page or the shield page includes the other of the plurality of shutter elements and the at least one coded image associated therewith.

18 Claims, 7 Drawing Sheets

U.S. PATENT DOCUMENTS

| | | | |
|---|---|---|---|
| 6,126,201 | A | 10/2000 | Pace et al. |
| 6,226,959 | B1 | 5/2001 | Krasuski et al. |
| 6,286,873 | B1 | 9/2001 | Seder |
| 6,445,347 | B1 | 9/2002 | Yoshimi |
| 6,591,523 | B2 | 7/2003 | Pines |
| 6,754,344 | B2 | 6/2004 | Kohli et al. |
| 6,905,019 | B2 | 6/2005 | Lacomis |
| 7,151,541 | B2 | 12/2006 | Seder |
| 7,240,442 | B2 | 7/2007 | Clegg |
| 7,278,570 | B2 | 10/2007 | McGee et al. |
| 7,278,584 | B1 | 10/2007 | Gandel et al. |
| 7,331,132 | B1 | 2/2008 | Seder |
| 2005/0011776 | A1 | 1/2005 | Nagel |
| 2005/0119023 | A1 | 6/2005 | Sudo et al. |
| 2007/0215694 | A1 | 9/2007 | Clegg |
| 2010/0011636 | A1* | 1/2010 | Cole ..... 40/124.09 |

* cited by examiner

ANIMATED FOLDABLE CARD

FIELD OF THE INVENTION

This invention is directed to a foldable card more particularly to a foldable card that includes an animation effect as it is opened.

BACKGROUND OF THE INVENTION

Cards that provide entertainment, such as sounds, animations, etc. are known. However, they are often difficult to assemble. Accordingly, a need exists for a card that provides an animation effect that is easy to assemble.

SUMMARY OF THE PREFERRED EMBODIMENTS

In accordance with one aspect of the present invention there is provided a method of assembling an animated foldable card moveable between an open position and a closed position. The method initially includes the step of providing a sheet that includes a base page, shield page, first intermediate page and second intermediate page all having top, bottom, left and right edges. The shield page includes a window defined therein and its bottom edge is hingedly connected to the top edge of the base page. The right edge of the first intermediate page is hingedly connected to the left edge of the base page, and the right edge of the second intermediate page is hingedly connected to the left edge of the first intermediate page. The card also includes a moveable page having top, bottom, left and right edges. The right edge of the moveable page is hingedly connected to the left edge of the second intermediate page, and the moveable page includes one of either a plurality of shutter elements or at least one coded image associated therewith. Either the base page or the shield page includes the other of the plurality of shutter elements and the at least one coded image associated therewith. The method further includes the steps of adhering the first intermediate page to the second intermediate page to form a cover member, moving the moveable page so that it overlies the base page, and adhering the shield page to the base page such that the moveable page is sandwiched therebetween to form a bottom member.

In an embodiment of the invention, the at least one coded image is associated with the base page and the plurality of shutter elements are associated with the moveable page. In another embodiment, the at least one coded image is associated with the moveable page and the plurality of shutter elements are associated with the shield page.

In accordance with one aspect of the present invention there is provided an animated foldable card that includes a base page, shield page, first intermediate page and second intermediate page all having top, bottom, left and right edges. The shield page includes a window defined therein and its bottom edge is hingedly connected to the top edge of the base page. The right edge of the first intermediate page is hingedly connected to the left edge of the base page, and the right edge of the second intermediate page is hingedly connected to the left edge of the first intermediate page. The card also includes a moveable page having top, bottom, left and right edges. The right edge of the moveable page is hingedly connected to the left edge of the second intermediate page, and the moveable page includes one of either a plurality of shutter elements or at least one coded image associated therewith. Either the base page or the shield page includes the other of the plurality of shutter elements and the at least one coded image associated therewith.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION

Figure 1:
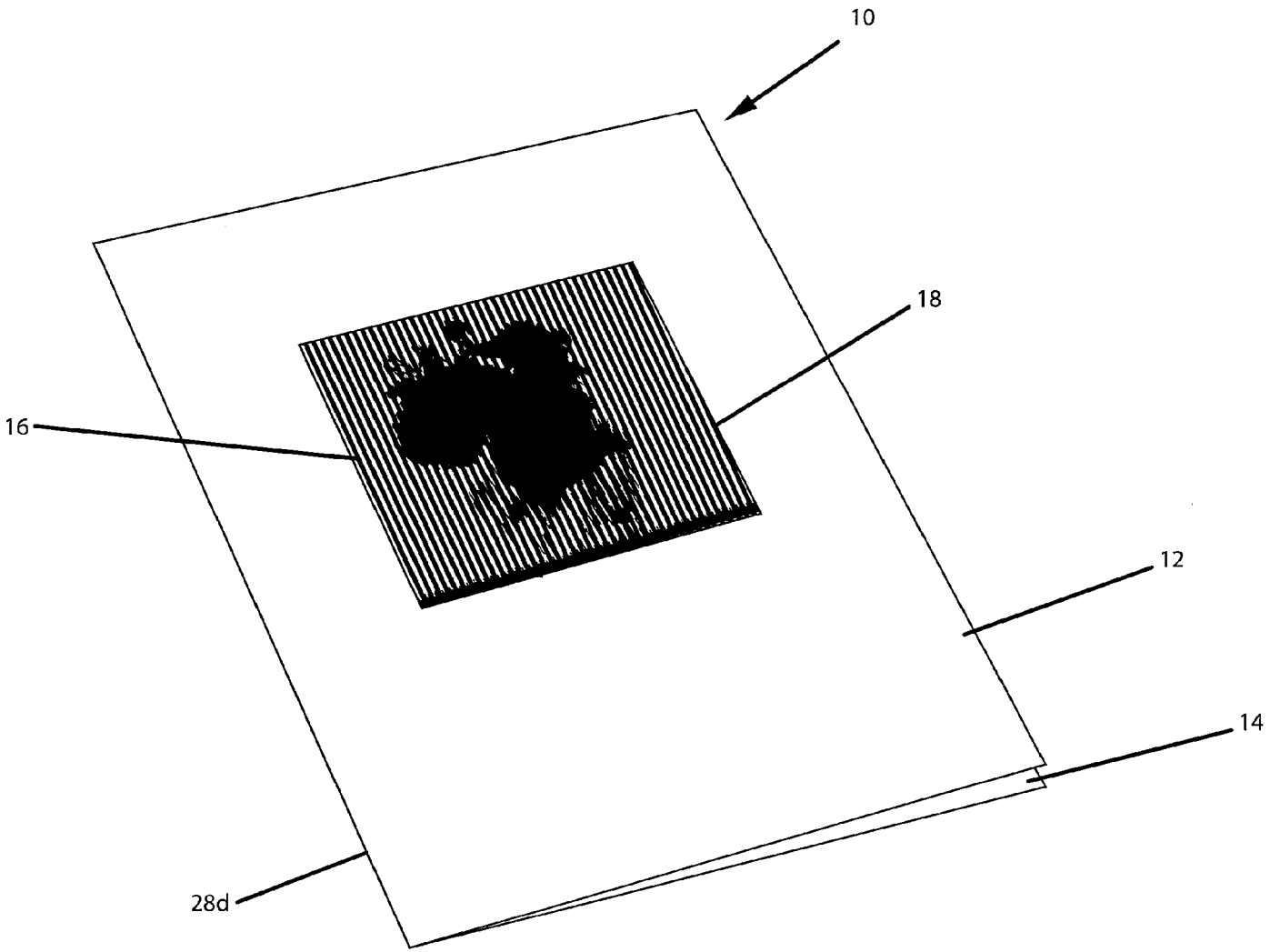
FIG. 1 is a perspective view of animated foldable card in accordance with a preferred embodiment of the present invention.

As shown in the accompanying drawings, the present invention is directed to an animated foldable card, generally indicated as 10, that is foldable between a closed position and an open position. It will be understood that an animation effect is provided by the action of opening or closing the card, as described more particularly below.

It will be appreciated that terms such as "front," "back," "top," "bottom," "left," "right," "above," and "side" used herein are merely for ease of description and refer to the orientation of the components as shown in the figures. It should be understood that any orientation of the components described herein is within the scope of the present invention.

With reference to FIGS. 1-4, the card 10 generally includes a cover member 12, a bottom member 14 and an animation portion 16, which is viewable through a window 18 in the cover member 12. Generally, when the cover member 12 is moved relative to the bottom member 14 (or vice versa) the animation portion 16 is activated.

Figure 2:
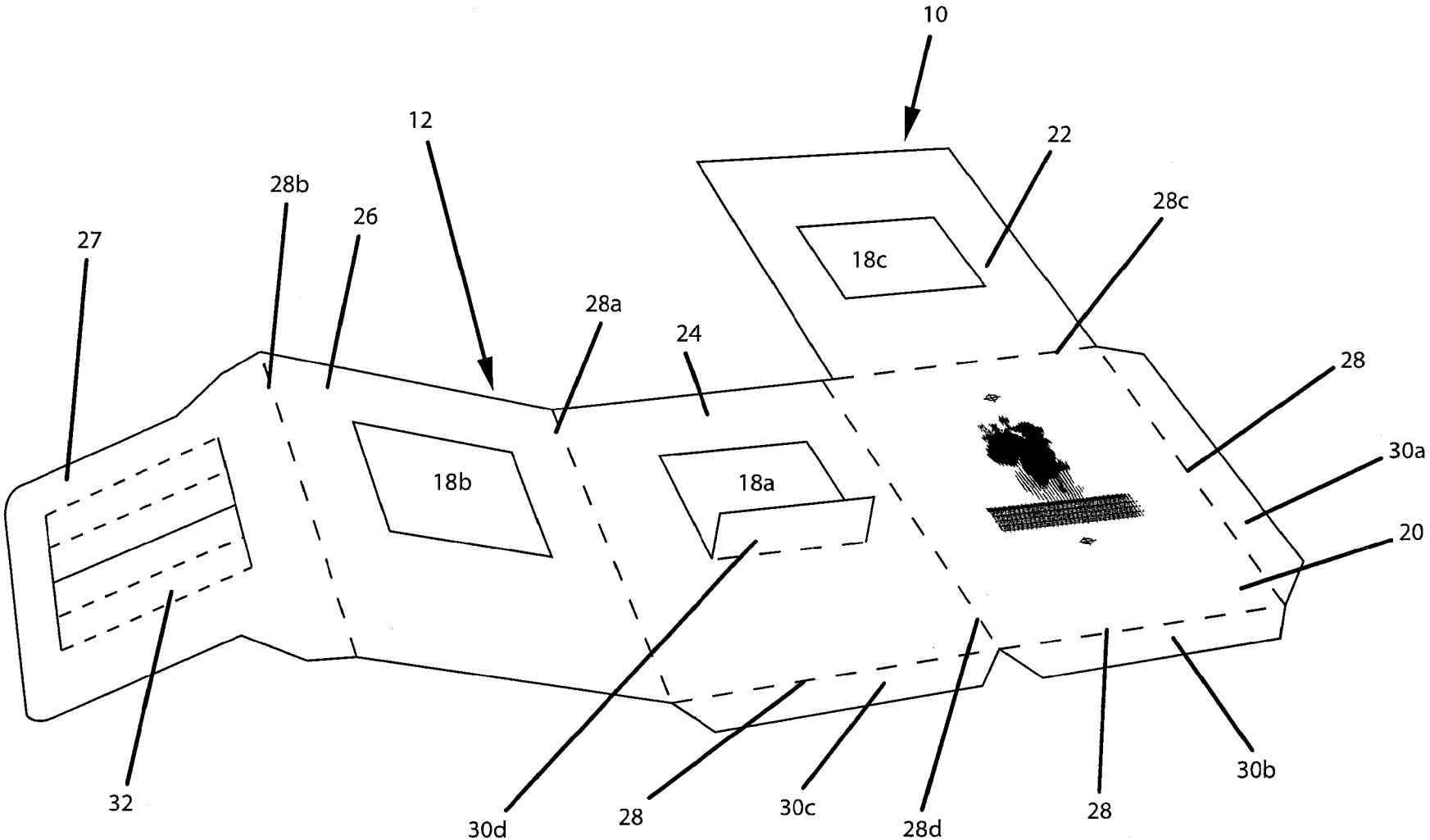
FIG. 2 is a perspective view of the card of FIG. 1 in an unassembled position.
Figure 3:
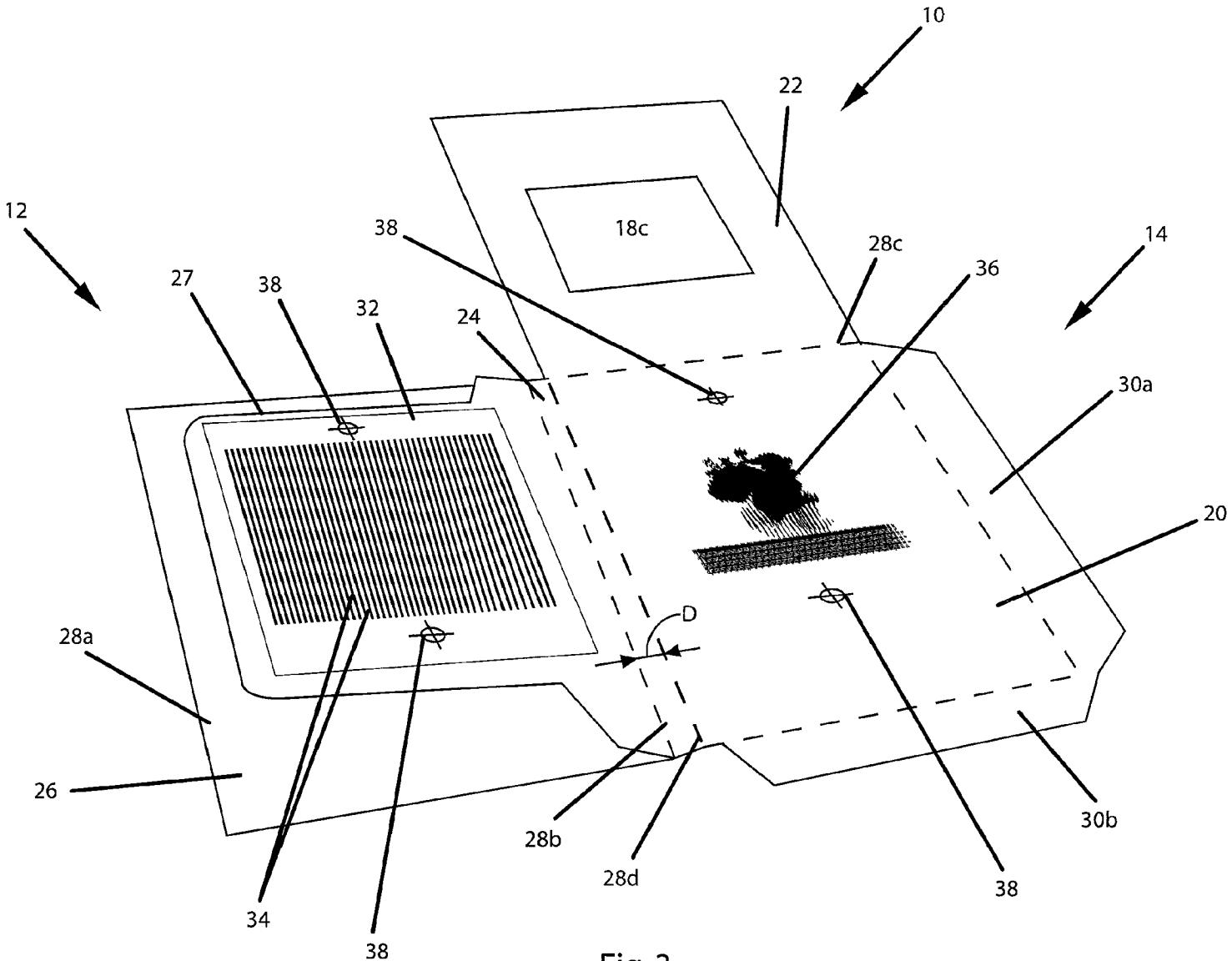
FIG. 3 is a perspective view of the card of FIG. 1 in a partially assembled position with the moveable page not overlying the base page.
Figure 4:
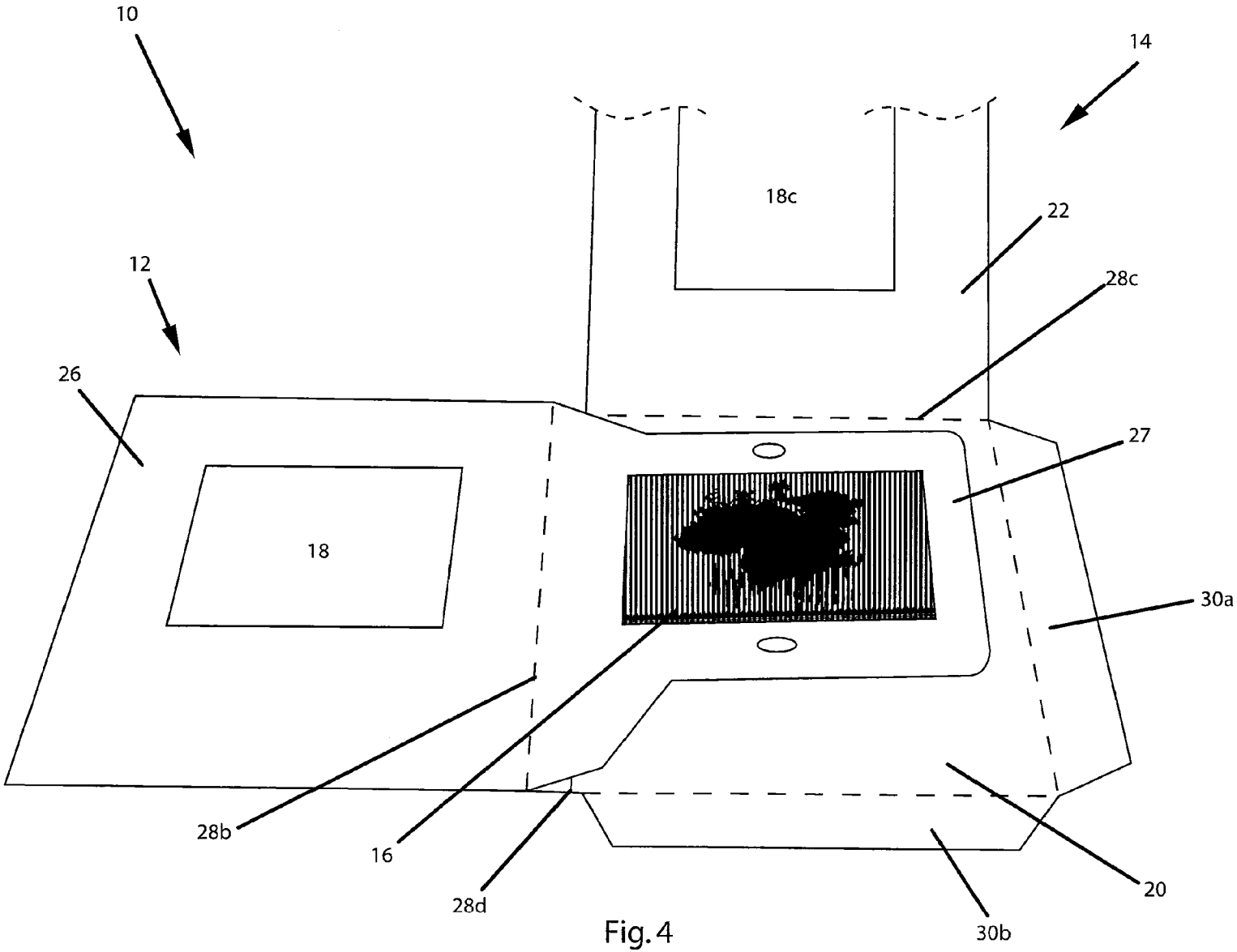
FIG. 4 is a perspective view of the card of FIG. 1 in a partially assembled position with the moveable page overlying the base page.

In a preferred embodiment, the majority of the card 10 is assembled from a single piece of material, such as paper card stock, plastic/acetate or the like. FIGS. 2-4 illustrate the different portions of the card 10 and how they are put together. As shown in FIG. 2, the unassembled card 10 includes a base page 20, shield page 22, first intermediate page 24, second intermediate page 26 and a moveable page 27 that are all hingedly connected by a series of folds 28. The folds will generally be designated herein as 28. However, some individual folds will be numbered, e.g., 28*a*-28*d*.

It will be understood that moveable page 27 and base page 20 include the elements that will form the animation portion 16. As shown in FIGS. 2-3, the moveable page 27 can have a screen sheet 32 attached thereto that includes a plurality of shutter elements or longitudinally extending spaced parallel lines 34 and base page 20 can include one or more coded images 36 thereon (e.g., an image of Santa Claus). The coded image(s) 36 can be printed directly on the base page 20 or can be adhered to the base page 20. In another embodiment, as is shown in FIG. 7, the coded image(s) 36 can be on the moveable page 27 and the spaced parallel lines 34 can be on the shield page 22. In the embodiment shown in FIGS. 1-6, generally, when the moveable page 27 is moved relative to the bottom member 14 (and particularly the base page 20), the movement of the spaced parallel lines 34 with respect to the coded image(s) 36 provides an animation effect. In the embodiment shown in FIG. 7, generally, when the moveable page 27 is moved relative to the shield page 22 (and particularly the screen sheet 32), the movement of the coded image(s) 36 with respect to the spaced parallel lines 34 provides an animation effect.

In the example shown in the figures, an image of a running Santa Claus is shown. It will be understood that the provision of complementary coded images and spaced parallel lines to provide animation is known in the art and therefore, a description of how it works will be omitted herein (for example, see U.S. Pat. No. 7,151,541 to Seder, issued Dec. 19, 2006, the entirety of which is incorporated herein by reference).

Figure 5B:
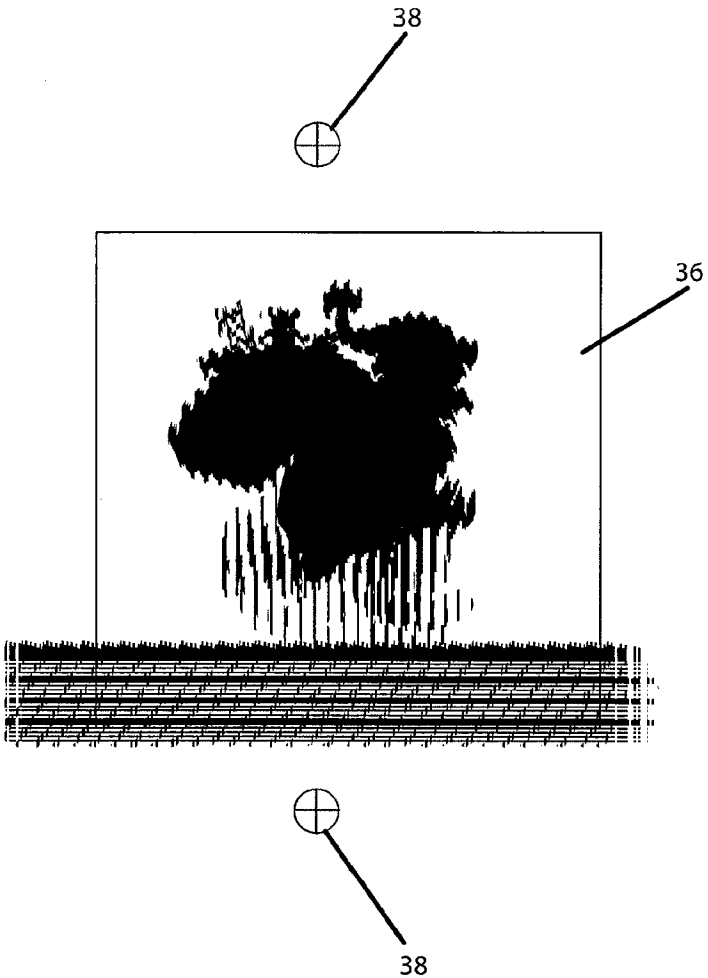
FIG. 5*b* is an example of coded image art.
Figure 5A:
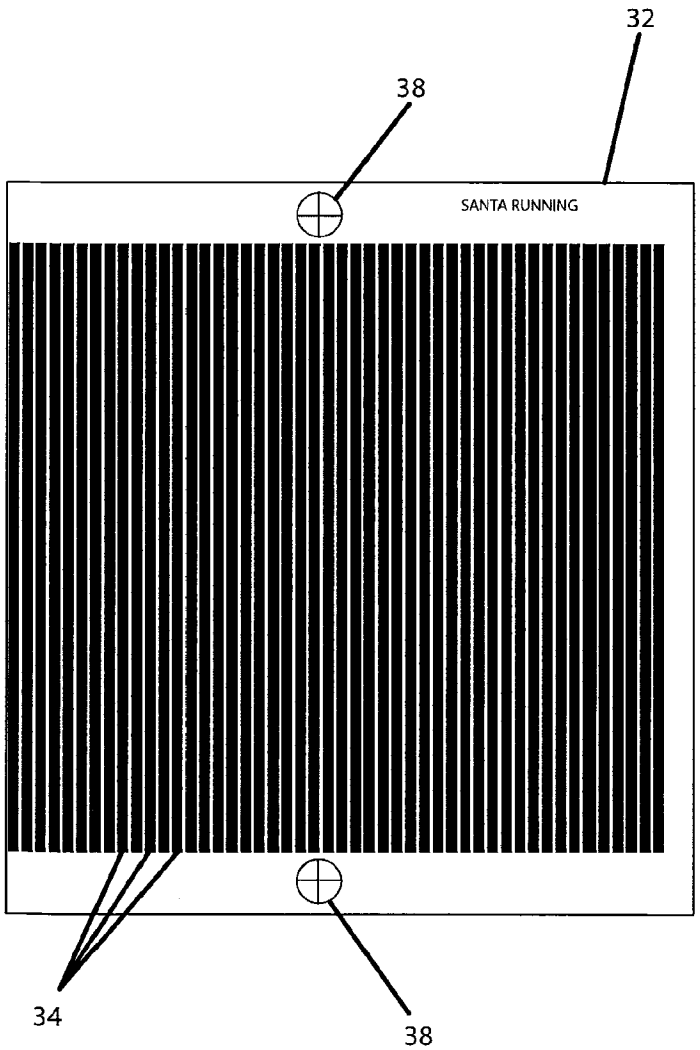
FIG. 5*a* is an elevational view of the screen sheet.

FIGS. 5*a* and 5*b* show an exemplary coded image 36(*s*) and screen sheet 32 with a plurality of spaced parallel lines 34. It will be understood that the running Santa Claus example given is merely an example of the infinite variety of coded images 36 possible under the present invention.

It should be clear that the shutter elements 34 may assume a wide variety of shapes including straight bars, curving bars, apertured opaque portions, and any other functioning configuration. Naturally, the shapes of the coded image(s) 36 would correspond to the shapes of the shutter elements 34. The plurality of viewing elements interposed between the shutter elements 34 could comprise open slots, transparent bars, or any other means that would allow a selective viewing of the coded image(s) 36.

To assemble the card 10, first, the first and second intermediate pages 24 and 26 are folded along fold 28*a* and adhered together using glue, tape or the like. This essentially forms cover member 12. First and second intermediate pages 24 and 26 each include a window 18*a* and 18*b* therein that form window 18 when the first and second intermediate pages 24 and 26 are adhered together. Because moveable page 27 is hinged to second intermediate page 26 along fold 28*b*, after first and second intermediate pages 24 and 26 have been adhered together, moveable page 27 is now adjacent and at least partially overlies base page 20. FIG. 3 shows the card 10 in a partially assembled position where the moveable page 27 is not overlying the base page and FIG. 4 shows the card 10 in a partially assembled position where the moveable page 27 is overlying the base page 20. To assemble the bottom member 14, with the moveable page 27 in the position shown in FIG. 4, the shield page 22, which is hinged to base page 20 along the base page's top edge by fold 28*c*, is folded over base page 20 and adhered thereto. Shield page 22 includes a window 18*c* therein that allows viewing of the animation portion 16 therethrough. It will be understood that when card 10 is in the closed position, window 18*c* aligns with windows 18*a* and 18*b* to form window 18 to allow viewing of the animation portion 16. In another embodiment, windows 18*a* and 18*b* can be omitted.

In a preferred embodiment, as shown in FIGS. 2-4, the various pages include a plurality of assembly flaps 30 that are hinged to the pages by a series of folds 28. In an embodiment with the assembly flaps 30, to assemble the bottom member 14, assembly flaps 30*a* and 30*b* are folded over base page 20 and shield page 22 is adhered to the assembly flaps 30*a* and 30*b*. This provides a pocket in which moveable page 27 can move. In an embodiment without the assembly flaps 30, the shield page 22 is adhered to the base page 20 along or adjacent to its edges, thereby still forming a pocket in which the moveable page 27 can move. As is shown in the figures, moveable page 27 preferably has a shape so that the majority of it is not as long from top to bottom as the shield member 22 and base page 20. This allows the shield member 22 and base page 20 to be adhered together (with or without the assembly flaps 30) and still leaves room for the moveable page 27 to move therein. Accordingly, it will be understood that adhering the shield page 22 to the base page 20 with the moveable page 27 sandwiched therebetween forms the bottom member 14.

Figure 6:
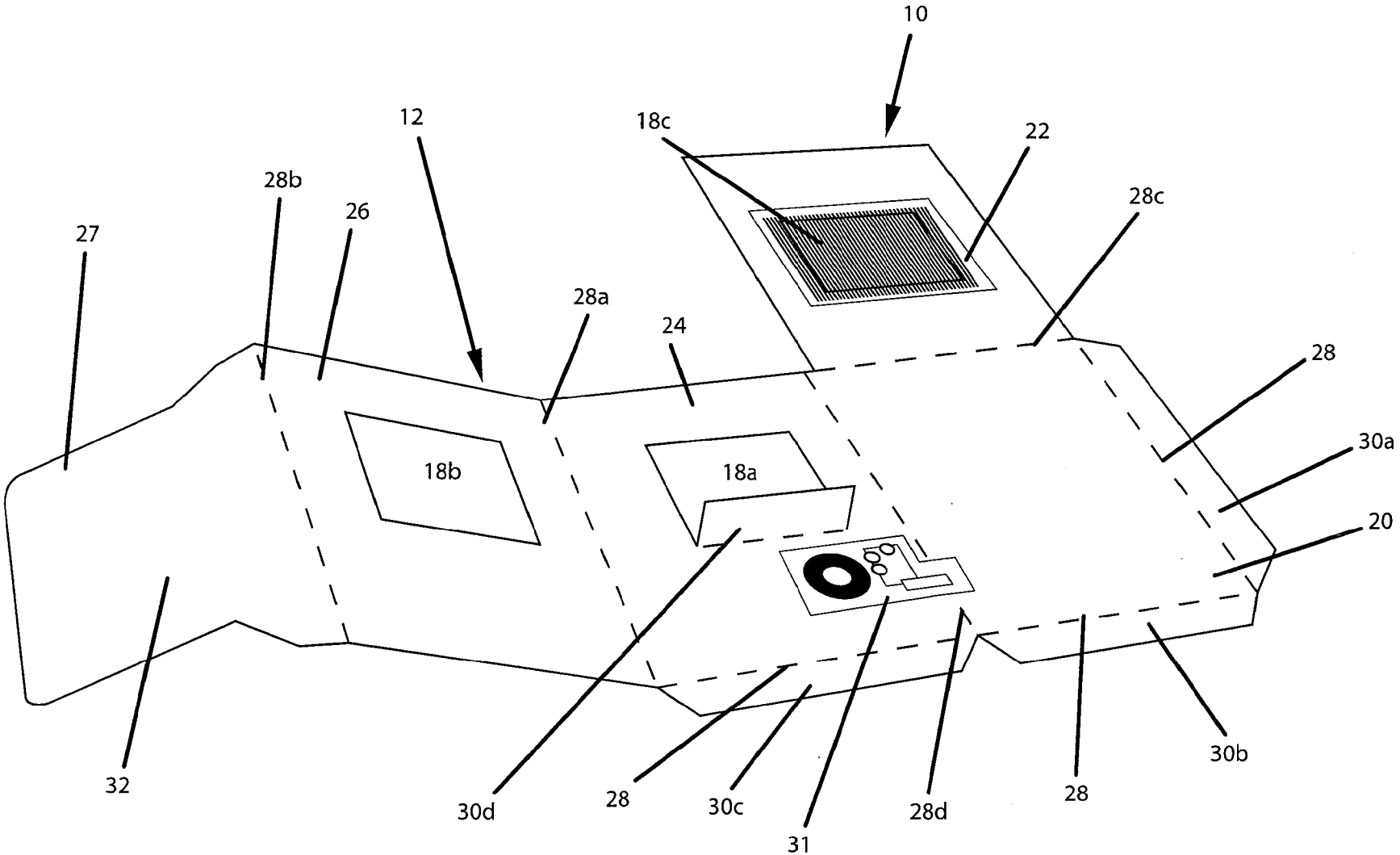
FIG. 6 is a perspective view of the card of FIG. 1 in an unassembled position with an electronics module included thereon.
Figure 7:
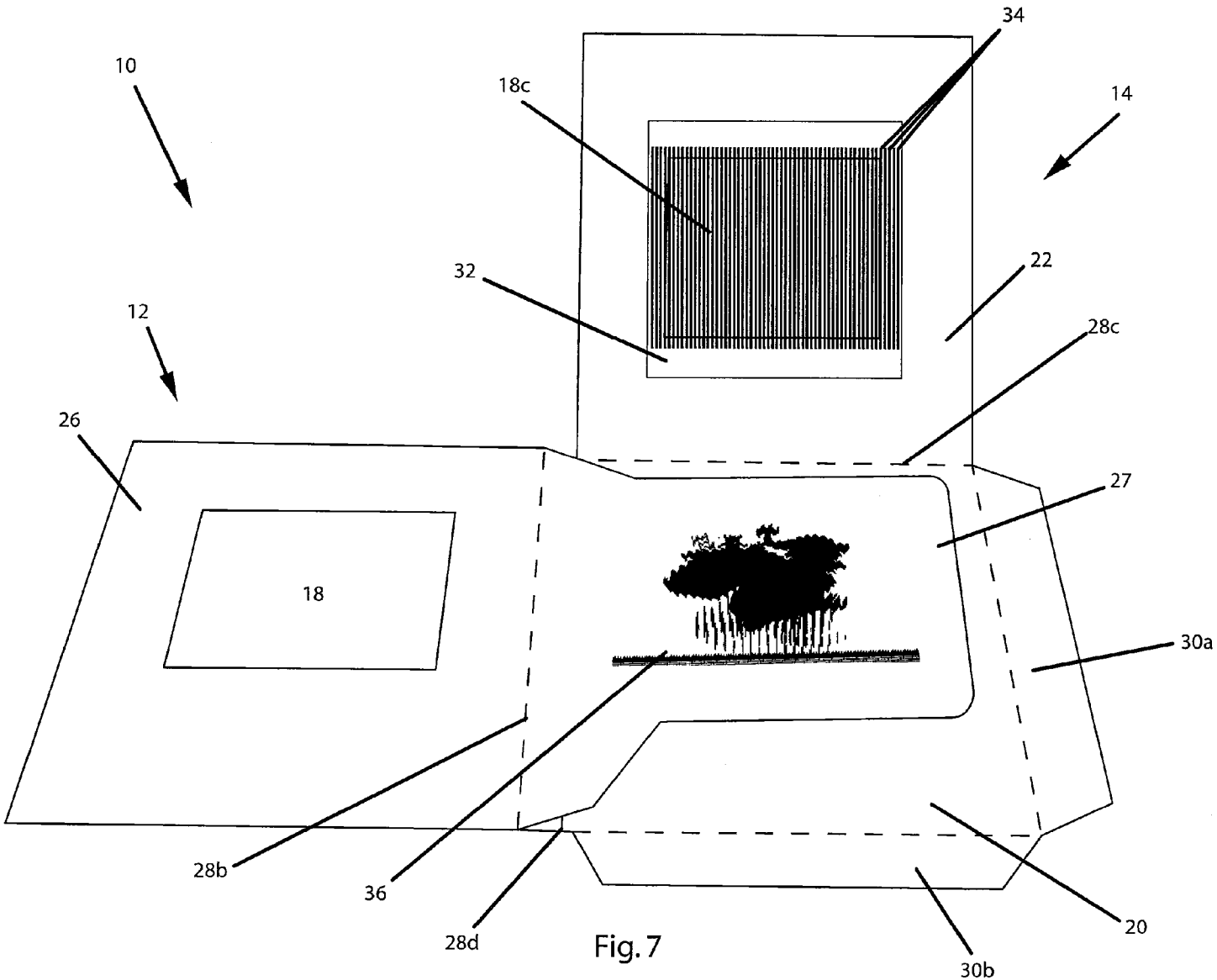
FIG. 7 is a perspective view of the card of an animated foldable card in a partially assembled position with the coded image on the moveable page and the spaced parallel lines on the shield page in accordance with an embodiment of the invention.

As shown in FIG. 6, in an embodiment, the card 10 can include an electronics module 31 that can provide light and/or sound to the animation. A small electronics module 31 is shown so as not to obscure the other components. In a preferred embodiment, when the card 10 is assembled, the assembly flaps 30*c* and 30*d* fold down and create a pocket that houses the electronics module 31.

After the card 10 has been assembled, the cover member 12 and bottom member 14 are moveable relative to one another along main card fold 28*d* (which is the fold that connects the base page 20 to the first intermediate page 24 in the unassembled state, as shown in FIG. 2). As shown in FIG. 3, after the cover member 14 has been properly assembled, because second intermediate page 26 is narrower than the first intermediate cover page 24, fold 28*b* and main card fold 28*c* are displaced from one another a distance D. Under this arrangement, a pivoting of the cover member 12 with respect to the bottom member 14, will induce a movement of the moveable page 27 relative to base page 20 thereby inducing an animation effect by the animation portion 16.

The components of the animated foldable card 10 can be formed from numerous different materials. For example, in one embodiment, the base page 20, shield page 22, first intermediate page 24, second intermediate page 26, moveable page 27 and assembly flaps 30 can all be manufactured from a single piece of die cut paper card stock with the coded image 36 printed directly thereon. The screen sheet 32, for example, can be made of acetate/plastic or a similar clear or translucent material imprinted with opaque spaced parallel lines 34.

In other embodiments, one or more of the base page 20, shield page 22, first intermediate page 24, second intermediate page 26, moveable page 27 and assembly flaps 30 can be formed of a separate sheet or different material and can be adhered, fused or otherwise connected or hinged together.

As FIGS. 2, 3 and 5*a*-5*b* show, the base page 20 and the moveable page 27 or screen sheet 32 can have a plurality of encircled "cross" 38 registration marks or other such registration marks disposed thereon. The registration marks 38 can ensure an accurate initial alignment of the spaced parallel lines 34 relative to the coded image(s) 36. By use of the registration marks 38, the alignment of the base page 20 relative to the moveable page 27 can be confirmed based on an alignment of the centers of "cross" registration marks 38 on the screen sheet 32 with those printed on the base page 20.

While certain embodiments of the invention have been described, these embodiments have been presented by way of example only, and are not intended to limit the scope of the inventions. For example, the card can be a greeting card, an invitation, an announcement, an advertisement, package, box, book or any other possible type of print collateral where there is relative movement between a cover and a bottom member. Indeed, the novel methods and elements described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A method of assembling an animated foldable card moveable between an open position and a closed position, the method comprising the steps of a) providing a sheet that includes i) a base page having top, bottom, left and right edges, ii) a shield page having top, bottom, left and right edges and a window defined therein, wherein the bottom edge of the shield page is hingedly connected to the top edge of the base page, iii) a first intermediate page having top, bottom, left and right edges, iv) a second intermediate page having top, bottom, left and right edges, wherein the right edge of the first intermediate page is hingedly connected to the left edge of the base page, and wherein the right edge of the second intermediate page is hingedly connected to the left edge of the first intermediate page, and v) a moveable page having top, bottom, left and right edges, wherein the right edge of the moveable page is hingedly connected to the left edge of the second intermediate page, wherein the moveable page includes one of either a plurality of shutter elements or at least one coded image associated therewith, and wherein either the base page or the shield page includes the other of the plurality of shutter elements and the at least one coded image associated therewith, b) adhering the first intermediate page to the second intermediate page to form a cover member, c) moving the moveable page so that it overlies the base page, and d) adhering the shield page to the base page such that the moveable page is sandwiched therebetween to form a bottom member.

2. The method of claim 1 wherein the base page includes a first assembly flap hingedly connected to the right edge thereof and a second assembly flap hingedly connected to the bottom edge thereof, and wherein the method further comprises folding the first and second assembly flaps over the base page, and adhering the shield page to the first and second assembly flaps with the moveable member sandwiched between the shield page and the base page to form the bottom member.

3. The method of claim 1 wherein the at least one coded image is printed directly on the base page.

4. The method of claim 1 wherein the first and second intermediate pages each include a window defined therein, and wherein in the closed position, the windows of the shield page and the first and second intermediate pages are substantially aligned.

5. The method of claim 1 wherein the at least one coded image is associated with the base page and the plurality of shutter elements are associated with the moveable page.

6. The method of claim 1 wherein the at least one coded image is associated with the moveable page and the plurality of shutter elements are associated with the shield page.

7. The method of claim 5 wherein the at least one coded image is printed directly on the base page, the moveable page includes a window defined therein and the plurality of shutter elements are printed on a screen sheet disposed in the window.

8. The method of claim 6 wherein the at least one coded image is printed directly on the moveable page and the plurality of shutter elements are printed on a screen sheet disposed in the window defined in the shield page.

9. An animated foldable card comprising:

a base page having top, bottom, left and right edges, a shield page having top, bottom, left and right edges and a window defined therein, wherein the bottom edge of the shield page is hingedly connected to the top edge of the base page, a first intermediate page having top, bottom, left and right edges, a second intermediate page having top, bottom, left and right edges, wherein the right edge of the first intermediate page is hingedly connected to the left edge of the base page, and wherein the right edge of the second intermediate page is hingedly connected to the left edge of the first intermediate page, and a moveable page having top, bottom, left and right edges, wherein the right edge of the moveable page is hingedly connected to the left edge of the second intermediate page, wherein the moveable page includes one of either a plurality of shutter elements or at least one coded image associated therewith, and wherein either the base page or the shield page includes the other of the plurality of shutter elements and the at least one coded image associated therewith.

10. The animated foldable card of claim 9 wherein the first intermediate page is adhered to the second intermediate page to form a cover member, and wherein the shield page is adhered to the base page with the moveable member sandwiched therebetween to form a bottom member.

11. The animated foldable card of claim 10 wherein movement of the cover member relative to the bottom member causes the moveable member to move, thereby providing an animation effect.

12. The animated foldable card of claim 9 wherein the first intermediate page is adhered to the second intermediate page to form a cover member, wherein the base page includes a first assembly flap hingedly connected to the right edge thereof and a second assembly flap hingedly connected to the bottom edge thereof, and wherein the first and second assembly flaps are folded over the base page and the shield page is adhered to the first and second assembly flaps with the moveable member sandwiched between the shield page and the base page to form a bottom member.

13. The animated foldable card of claim 9 wherein the at least one coded image is printed directly on the base page.

14. The animated foldable card of claim 10 wherein the at least one coded image is printed directly on the base page.

15. The animated foldable card of claim 9 wherein the at least one coded image is associated with the base page and the plurality of shutter elements are associated with the moveable page.

16. The animated foldable card of claim 9 wherein the at least one coded image is associated with the moveable page and the plurality of shutter elements are associated with the shield page.

17. The animated foldable card of claim 15 wherein the at least one coded image is printed directly on the base page, the moveable page includes a window defined therein and the plurality of shutter elements are printed on a screen sheet disposed in the window.

18. The animated foldable card of claim 16 wherein the at least one coded image is printed directly on the moveable page and the plurality of shutter elements are printed on a screen sheet disposed in the window defined in the shield page.

* * * * *